US006989500B2

(12) United States Patent
Simon et al.

(10) Patent No.: US 6,989,500 B2
(45) Date of Patent: Jan. 24, 2006

(54) LIQUID METAL CONTACT REED RELAY WITH INTEGRATED ELECTROMAGNETIC ACTUATOR

(75) Inventors: Jonathan Simon, Castro Valley, CA (US); Steven A. Rosenau, Mountain View, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/857,205

(22) Filed: May 28, 2004

(65) Prior Publication Data

US 2005/0264384 A1 Dec. 1, 2005

(51) Int. Cl.
*H01H 29/00* (2006.01)

(52) U.S. Cl. ..... 200/182; 200/188; 200/214

(58) Field of Classification Search ..... 200/182–183, 200/187–191, 209–219, 233–236; 335/47–58
See application file for complete search history.

(56) References Cited

U.S. PATENT DOCUMENTS 4,156,216 A * 5/1979 Bath ..... 335/51
6,831,532 B2 * 12/2004 Fong et al. ..... 335/47
6,876,133 B2 * 4/2005 Wong ..... 310/328

OTHER PUBLICATIONS

EETIMES, "MEMS switch ueses magnetic actuation," Jun Shen et al., Jul. 12, 2001.*

* cited by examiner

*Primary Examiner*—Lincoln Donovan
(74) *Attorney, Agent, or Firm*—Juergen Krause-Polstorff

(57) ABSTRACT

A miniaturized relay with an integrated electromagnetic actuator allows scaling a reed relay to a small size to reduce the power needed to actuate it while retaining a high quality liquid metal contact. A dragged liquid metal contact is used. Coplanar waveguides may be used for the switched signal instead of microstrip transmission lines to reduce transmission line discontinuities that occur due to impedance changes.

23 Claims, 6 Drawing Sheets

LIQUID METAL CONTACT REED RELAY WITH INTEGRATED ELECTROMAGNETIC ACTUATOR

CROSS-REFERENCE TO RELATED APPLICATIONS

This application relates to the co-pending application Ser. No. 10/857,306 filed on May 28, 2004, entitled "Liquid Metal Contact Microrelay" by Simon and Rosenau owned by the assignee of this application and incorporated herein by reference.

BACKGROUND

A reed relay is a common type of relay. The reed relay includes one or more thin cantilevered metal arms or reeds made of paramagnetic material such as permalloy (typically, 80% nickel, 20% iron. In the presence of a magnetic field, the reeds experience a force and move to make contact with one another or another electrode to complete a circuit. Typical problems with reed relays are the requirements for high currents to latch and hold the connection and the high contact resistance that is present because of the relatively low force contact. Typical designs also suffer from poor radio frequency (RF) properties at greater than about 2 GHz because the un-terminated cantilevers act as antennas when the relay is open. An improvement to the typical reed relay is obtained by replacing the solid contacts with a thin mercury layer to reduce the contact resistance. This is typically known as a mercury film relay.

It is sometimes desirable to have a relay that can operate at speeds greater than 3 kHz. To increase the switching speed of a mechanical relay, the size of the mechanical relay typically needs to be scaled down in size to reduce inertia. MEMS (MicroElectroMechanical Systems) techniques have been adapted to produce a wide variety of small sized relays. Most such small sized relays have increased contact resistance because as the relay is scaled down in size the contact forces are also scaled down. Stiction forces increase as the relay is scaled down because surface forces scale with the area while restoring forces scale with the volume and stiction may become a problem if the devices are not handled appropriately during production and hermetically packaged. Mercury film relays typically cannot be significantly scaled down in size because of the surface tension forces that arise due to the smaller radius of the meniscus and act to prevent the relays from switching.

SUMMARY OF THE INVENTION

In accordance with the invention, a miniaturized relay with an integrated electromagnetic actuator allows for scaling a reed relay to a small size to reduce the power needed to actuate it while retaining a high quality liquid metal contact that is scalable. A dragged liquid metal contact is used. Coplanar waveguides may be used for the switched signal instead of microstrip transmission lines to reduce transmission line discontinuities due to impedance changes.

DETAILED DESCRIPTION OF THE INVENTION

Figure 1A:
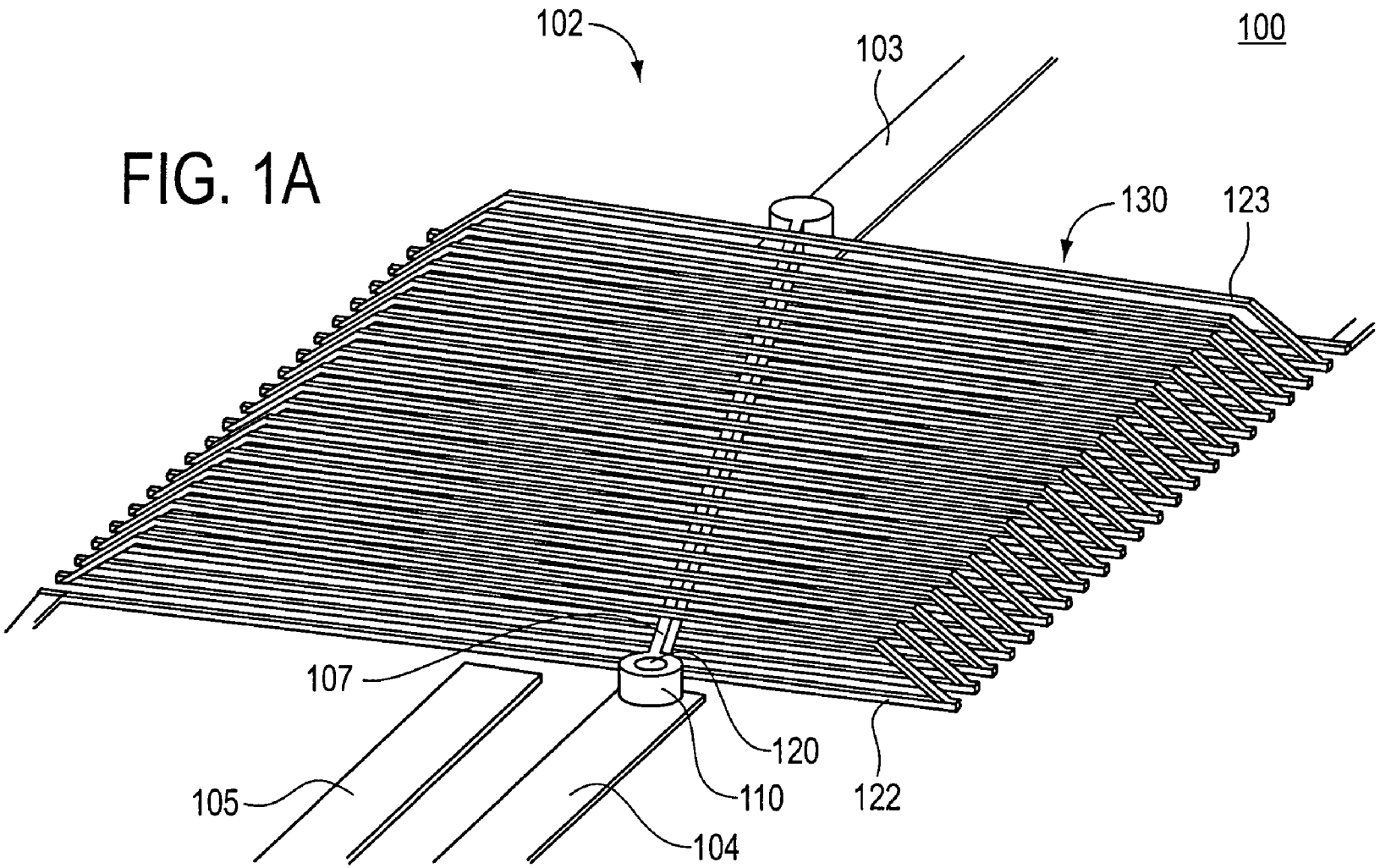
FIGS. 1*a–c* show an embodiment in accordance with the invention

FIG. 1*a* shows an embodiment in accordance with the invention. Liquid metal contact reed relay 100 in FIG. 1*a* has cantilever 107 that is typically a composite made from a magnetic material such as permalloy together with a highly conductive layer of Al, Au, Cu or other highly conductive material to improve RF transmission performance. An intermetalic barrier metallization, such as, for example, Ti—Pt, Ti—W, Cr or other similar material may be used between the permalloy and the highly conductive layer. Typical thickness for the highly conductive layer is on the order of thousands of Angstroms while the thickness of the barrier layer is on the order of hundreds of Angstroms.

For example, cantilever 107 has a typical linear dimension of about 1 mm, a typical height of about 25 $\mu$m and a typical width of about 10 $\mu$m. Cantilever 107 is suspended over substrate surface 102, typically made from silicon, ceramic or other suitable dielectric. Liquid metal contact reed relay 100 is a single poll, double throw relay although other configurations are possible such as, for example, single poll, single throw; double poll, single throw and double poll, double throw relays.

The substrate typically has a ground plane (not shown) typically a thin layer of aluminum (Al) or aluminum silicide, gold (Au) or copper (Cu) or other suitable conductor, located on the substrate face opposite to surface 102 of the substrate. A barrier/adhesion layer on the order of hundreds of angstroms, such as a Ti—Pt, Ti—W or Cr layer, is typically used between the ground plane (not shown) and the substrate face opposite to surface 102. Note that cap 125 is cutaway in FIGS. 1*a–b* except for patterned traces 123 which are part of cap 125. Additional sealing structures may be fabricated on the bottom of cap 125 and surface 102 of substrate 101 to provide for a hermetic seal using, for example, a gold—gold compression technique. Use of typical lithographic techniques such as those disclosed in "Fundamentals of Microfabrication: The Science of Miniaturization", Marc Madou, CRC Press, 2002, allows many thousands of liquid metal contact reed relays 100 to be fabricated in parallel and multiple liquid metal contact reed relays 100 may be integrated into a single package allowing for added capabilities.

Figure 1B:
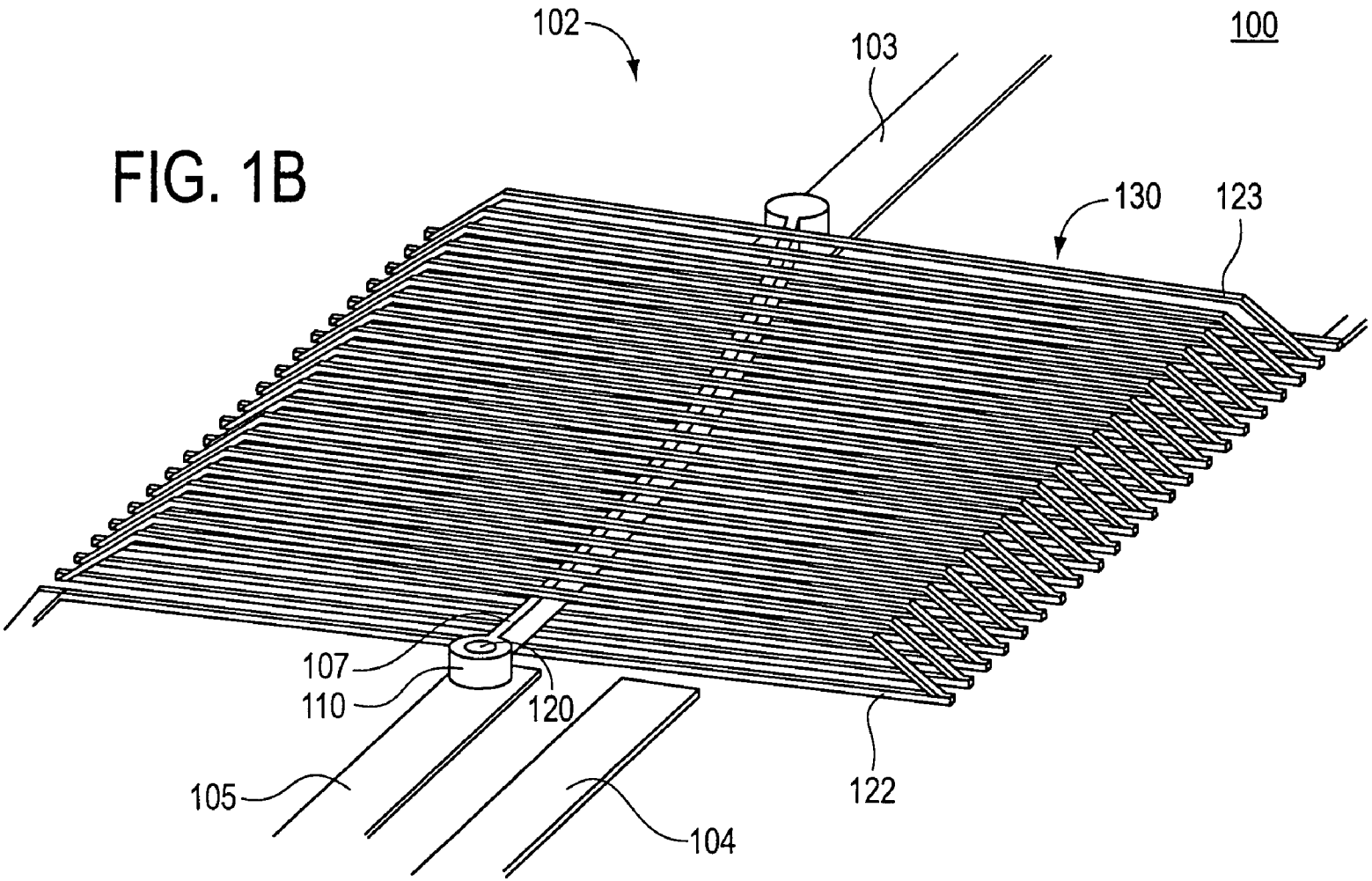

Cantilever 107 is fabricated such that well 110 is positioned at one end of cantilever 107. Well 110, for example, typically has an inner diameter of about 25 $\mu$m Well 110 contains mercury, gallium alloy or other suitable liquid metal alloy drop 120 that is in contact with substrate surface 102. Well 110 may have a circular, elliptical or other appropriate shape. On substrate surface 102 there are signal electrodes 103, 104, 105. Signal electrodes 103, 104, 105 in a first switched state as shown in FIG. 1*a* make an electrical connection from signal electrode 103 through cantilever 107 through liquid metal drop 120 to signal electrode 104. In a second switched state as shown in FIG. 1*b*, signal electrodes 103, 104, 105 make an electrical connection from signal electrode 103 through cantilever 107 through liquid metal drop 120 to signal electrode 105. Typical current carrying capacities for liquid metal contact reed relay 100 are on the order of 10 mA for Hg liquid metal drop 120 having about a 25 $\mu$m diameter. The diameter of liquid metal drop 120 is the limiting factor because the boiling point of liquid metal drop is typically much less than melting point of cantilever 107. Typically, the driving signal is on signal electrode 103 and signal electrodes 104, 105 may be signal paths or termination.

Figure 1C:
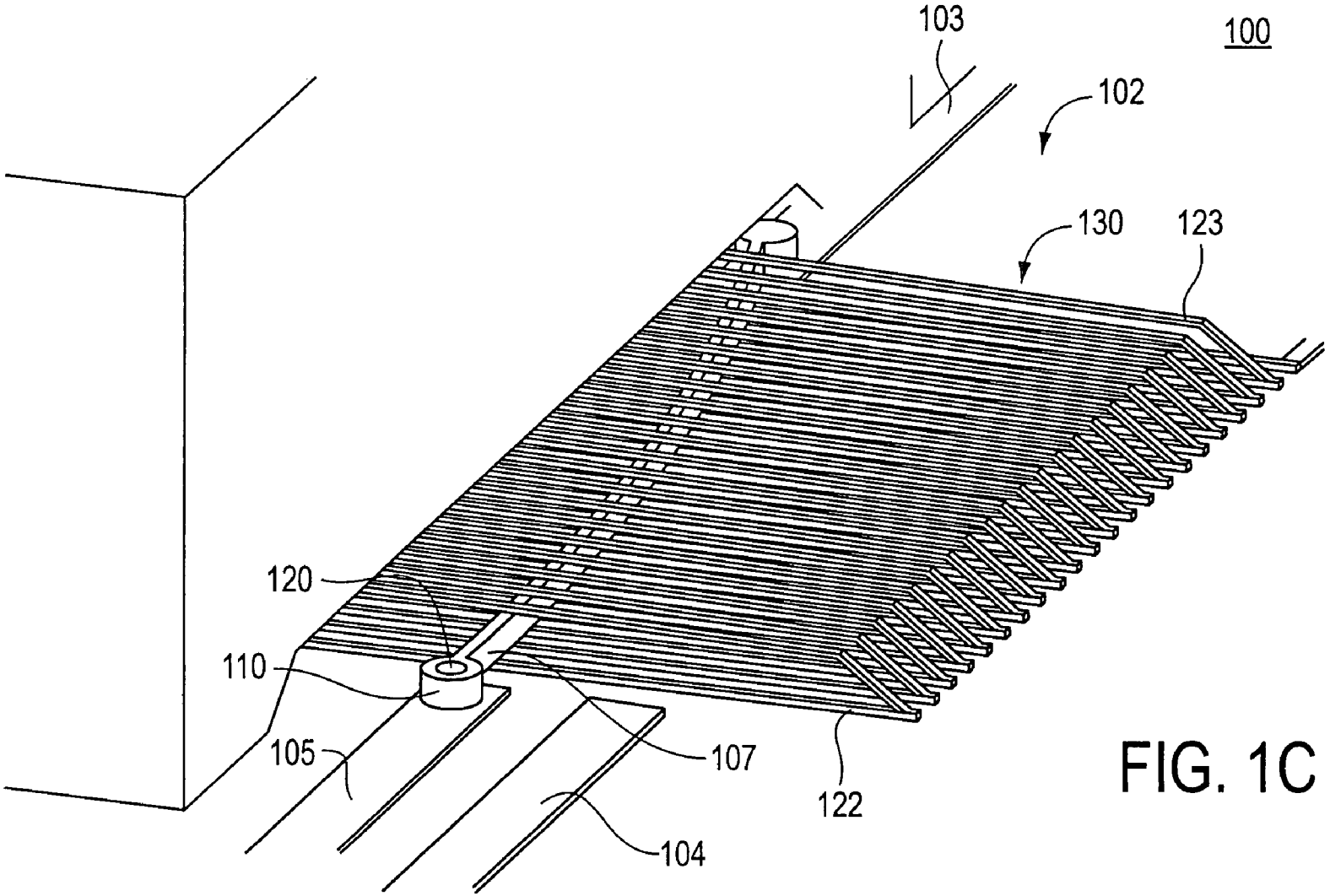

Substrate surface 102 has electrical traces 122 on it that run substantially perpendicular to cantilever 107. With reference to FIG. 1*c*, liquid metal contact reed relay 100 has cap 125 (shown partially cutaway in FIG. 1*c*) which typically has etched cavity 126 containing patterned traces 123 at an angle with respect to traces 122 so that adjoining traces 122 are electrically connected. When cap 125 is properly aligned and brought together with surface 102 of substrate 101, traces 122 and 123 together form inductor 130 with cantilever 107 at the center. When a current passes through inductor 130, a magnetic field substantially perpendicular to traces 122 and 123 is created. To obtain about a 20 $\mu$T magnetic field from inductor 130, a winding current of about 1 mA and about 16 turns/mm are required. The magnetic field places a magnetic force, for example, typically on the order of 200 $\mu$N on cantilever 107 to move liquid metal alloy drop 120 in well 110 to signal electrode 105. When the winding current is removed from inductor 130, the spring force on cantilever 107, for example, typically on the order of about 200 $\mu$N, moves liquid metal alloy drop 120 in well 110 to signal electrode 104.

For microstrip transmission lines, the impedance is determined by the scale of the respective signal conductor's dimensions to the distance to ground plane 115. If signal electrodes 103, 104, 105 and cantilever 107 are microstrips, large discontinuities in impedance are typically present at each end of cantilever 107 because of the changing distance to ground plane 115 (see FIGS. 1*a*–1*c*) as the signal transitions from signal electrodes 104 or 105 and signal electrode 103 on substrate surface 102 to cantilever 107.

Figure 2A:
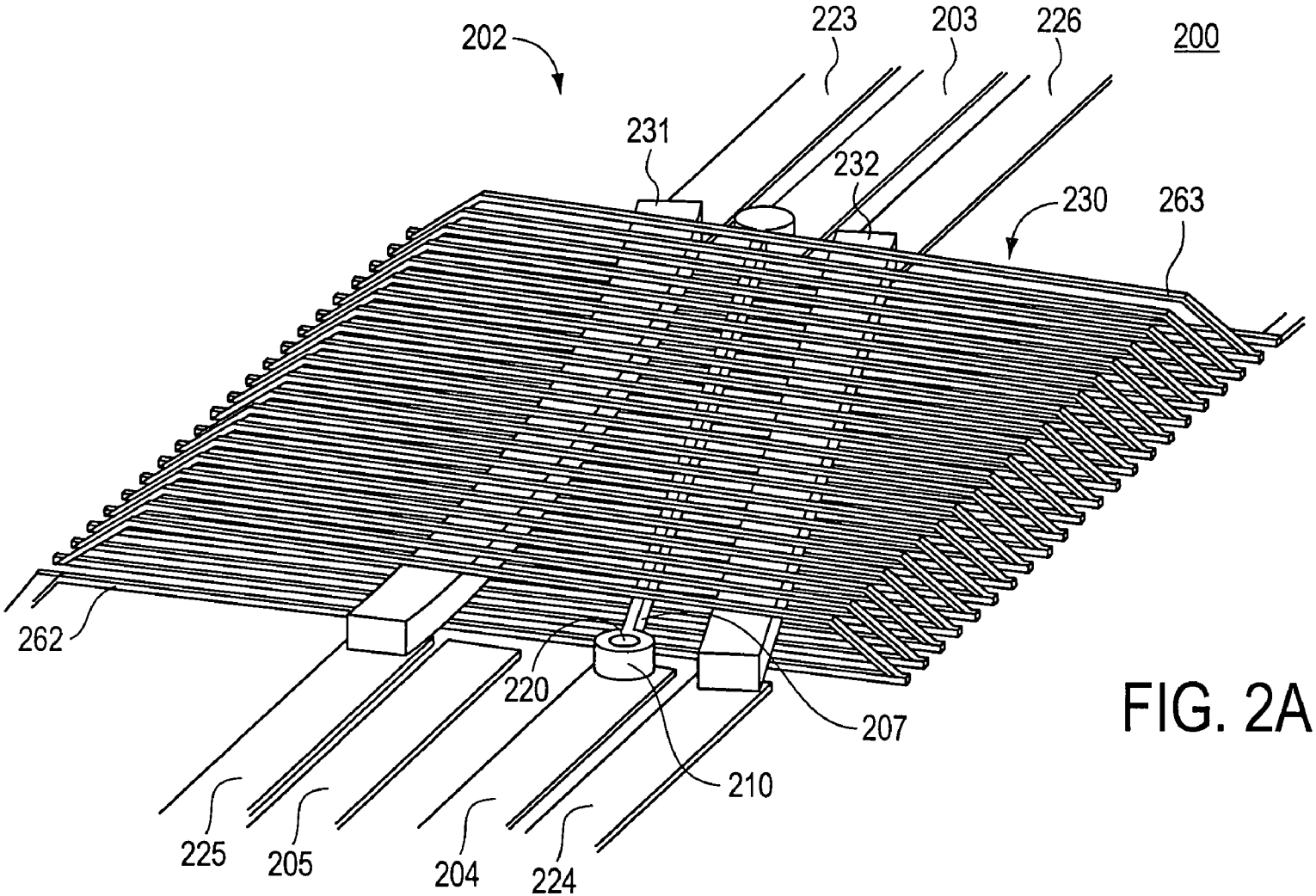
FIGS. 2*a–c* show an embodiment in accordance with the invention.
Figure 2B:
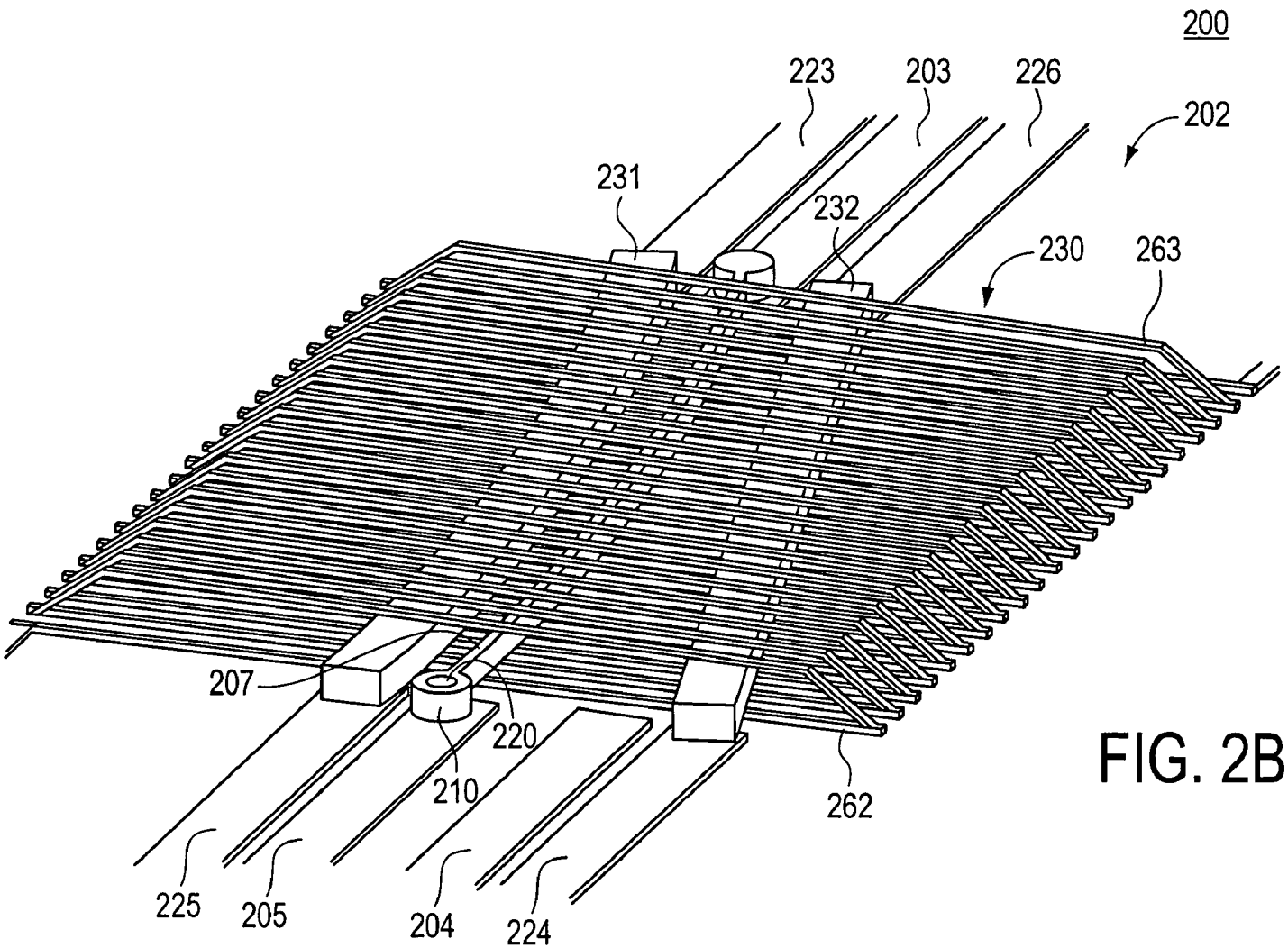
Figure 2C:
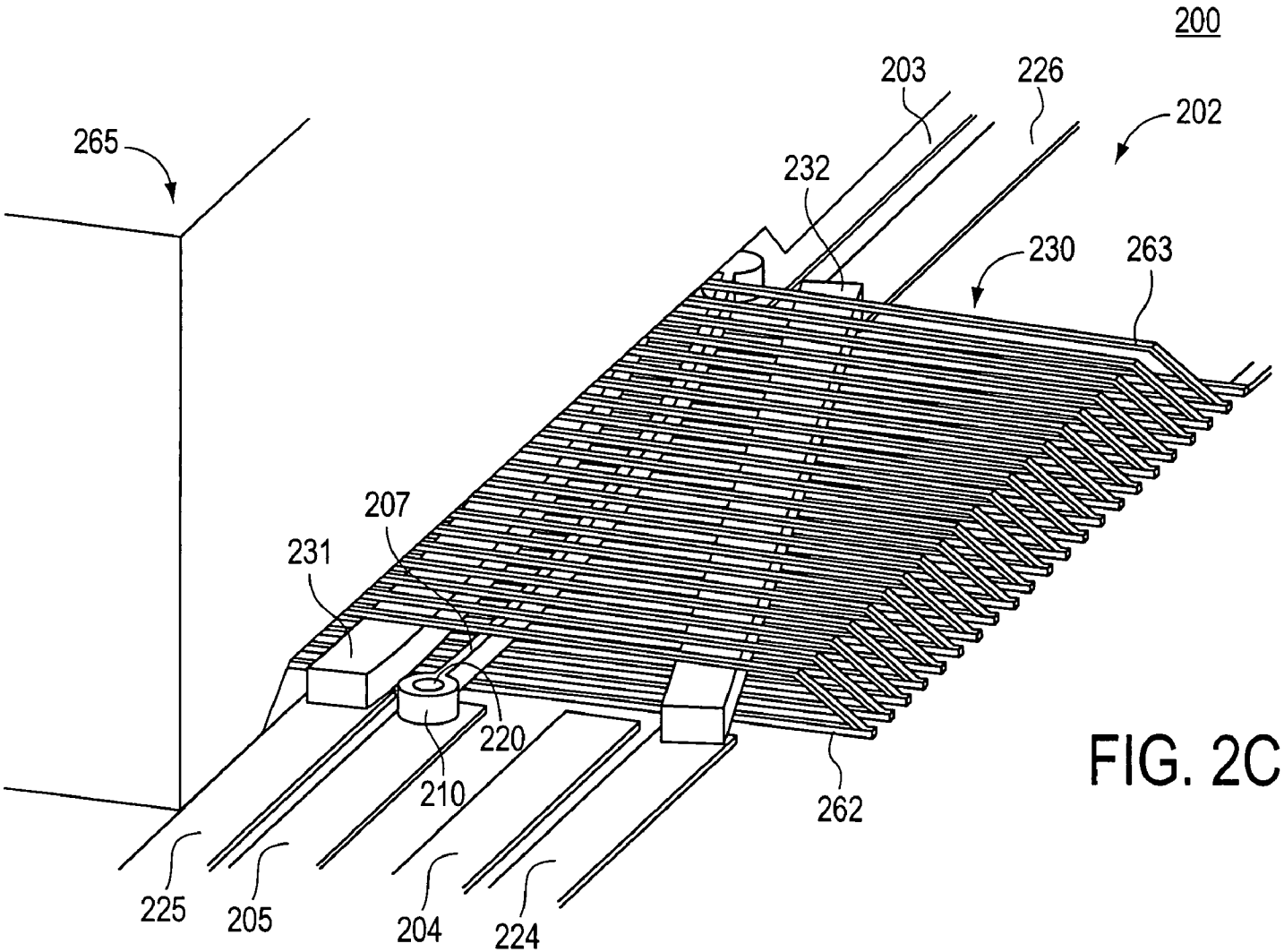

Coplanar waveguides use ground conductors that are coplanar with the signal conductors. Hence, the impedance is controlled by the width of the signal conductors and the gap between the ground conductors and the signal conductors. FIGS. 2*a*–*c* show an embodiment in accordance with the invention that reduces the discontinuity problems that may result in impedance variations, particularly at higher frequencies by using coplanar waveguides. The numerical parameters for the embodiment in FIGS. 2*a*–*c* are the same as that for the embodiment in FIGS. 1*a*–c above.

Liquid metal contact reed relay 200 in FIG. 2*a* has cantilever 207 that is typically made from a magnetic material such as permalloy and is suspended over substrate surface 202, typically silicon, ceramic or other suitable dielectric. The substrate typically has a ground plane, typically a thin layer of aluminum (Al), gold (Ag) or copper (Cu), located on the substrate face opposite to substrate surface 202. Note that cap 265 is cutaway in FIGS. 2*a*–*b* except for patterned traces 263 which are part of cap 265. Cantilever 207 is fabricated such that well 210 is positioned at one end of cantilever 207. Well 210 contains liquid mercury, gallium alloy or other suitable liquid metal alloy drop 220 that is in contact with substrate 201. Well 210 may have a circular, elliptical or other appropriate shape. On substrate surface 202 there are signal electrodes 203, 204, 205 and RF ground electrodes 223, 224, 225, 226.

Substrate surface 202 has metal traces 262 on it that run substantially perpendicular to cantilever 207. With reference to FIG. 2*c*, liquid metal contact reed relay 200 has cap 265 (shown partially cutaway in FIG. 2*c*) which typically has etched cavity 266 containing patterned traces 263 at an angle with respect to traces 262 so that adjoining traces 122 are electrically connected. When cap 265 is properly aligned and brought together with substrate surface 202, traces 262 and 263 together form inductor 230 with cantilever 207 at the center. When a current passes through inductor 230 to actuate liquid metal contact reed relay 200, a magnetic field substantially perpendicular to traces 262 and 263 is created. The magnetic field places a magnetic force on cantilever 207 moving liquid metal alloy drop 220 in well 210 to signal electrode 205. When current is removed from inductor 230, the spring force on cantilever 207 moves liquid metal alloy drop 220 in well 210 to signal electrode 204. Additional sealing structures may be fabricated on the bottom of cap 265 and surface 202 of substrate 201 to provide for a hermetic seal using, for example, a gold—gold compression technique.

Signal electrodes 203, 204, 205 in the unactuated state as shown in FIG. 2*a* make an electrical connection from signal electrode 203 through cantilever 207 to liquid metal drop 220 in well 210 and on to signal electrode 204. In the actuated state when current is passed through electromagnet 230 as shown in FIG. 2*b*, signal electrodes 203, 204, 205 make an electrical connection from signal electrode 203 through cantilever 207 to liquid metal drop 220 and on to signal electrode 205. Typically, the driving signal is on signal electrode 203 and signal electrodes 204, 205 may be signal paths or termination.

In an embodiment in accordance with the invention, liquid metal contact reed relay 200 as shown in FIGS. 2*a*–*c* is designed to reduce the discontinuities resulting in impedance variations. Signal electrodes 203, 204, 205 are made co-planar waveguides by introducing electrode 225 next to signal electrode 205, electrode 224 next to electrode 204, electrodes 223 and 226 bordering electrode 203 with raised metal trace 231 electrically connecting electrode 225 to electrode 223 and raised metal trace 232 electrically connecting electrode 224 to electrode 226 reduces the discontinuity problems. Note that the dimensions of raised metal trace 231 and 232 are typically on the order of cantilever 207. Electrodes 223, 224, 225, 226 are typically kept at RF ground along with raised metal traces 231 and 232. Introducing the appropriate curvatures for raised traces 231 and 232 reduces the discontinuities resulting in transmission line impedance variations. For example, as shown in FIGS. 2*a*–*c* for purposes of illustration, raised trace 231 has a curvature that matches the curvature of cantilever 207 when liquid metal contact reed relay 200 is in the actuated state and raised trace 232 has a curvature that matches the curvature of cantilever 207 in the unactuated state. Typically, however, in order to reduce the discontinuities, the curvature of cantilever 207 will not exactly match the curvature of raised traces 231 and 232 in the actuated and unactuated state, respectively. Hence, transmission line characteristic impedance of the signal path does not depend on the on/off state of liquid metal contact reed relay 200.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A contact reed relay comprising:

a substrate having a first and a second surface;

a plurality of electrodes disposed on said first surface of said substrate;

an inductor comprised of a first set of traces disposed on said first surface of said substrate;

a cantilever disposed over said first set of traces disposed on said first surface of said substrate and oriented substantially perpendicular to said traces of said inductor, said cantilever having a first and a second end, said first end electrically coupled to a first one of said plurality of electrodes and said second end capable of electrically coupling to a second one or third one of said plurality of electrodes; and a well disposed at said second end of said cantilever, said well formed to contain a dragged contact.

2. The contact reed relay of claim 1 wherein said dragged contact comprises liquid mercury.

3. The contact reed relay of claim 1 wherein said dragged contact comprises a gallium alloy.

4. The contact reed relay of claim 1 wherein said well is substantially circular in shape.

5. The contact reed relay of claim 1 further comprising a cap covering said contact reed relay, said cap comprising a second set of traces electrically coupled to said first set of traces to form said inductor.

6. The contact reed relay of claim 5 wherein said cap hermetically seals said contact reed relay.

7. The contact reed relay of claim 1 wherein said cantilever is comprised of permalloy.

8. The contact reed relay of claim 1 wherein said cantilever is plated with a highly conductive layer.

9. The contact reed relay of claim 1 further comprising a first raised trace and a second raised trace disposed on said first surface of said substrate such that said cantilever lies between said first and said second raised trace.

10. The contact reed relay of claim 9 wherein said first raised trace is curved.

11. The contact reed relay of claim 9 wherein said first and said second raised trace are electrically coupled to RF ground.

12. The contact reed relay of claim 1 wherein said second surface of said substrate comprises a ground plane.

13. The contact relay of claim 1 wherein said substrate is ceramic.

14. A method for making a contact reed relay comprising:

providing a substrate having a first and a second surface;

placing a plurality of electrodes on said first surface of said substrate;

placing a first set of traces on said first surface of said substrate to comprise an inductor;

placing a cantilever over said first set of traces disposed on said first surface of said substrate and oriented substantially perpendicular to said traces of said inductor, said cantilever having a first and a second end, said first end electrically coupled to a first one of said plurality of electrodes and said second end capable of electrically coupling to a second one or third one of said plurality of electrodes; and forming a well at said second end of said cantilever, said well formed to contain a dragged contact.

15. The method of claim 14 wherein said dragged contact comprises liquid mercury.

16. The method of claim 14 wherein said well is substantially circular in shape.

17. The method of claim 14 further comprising providing a cap covering said contact reed relay, said cap comprising a second set of traces electrically coupled to said first set of traces to form said inductor.

18. The method of claim 14 wherein said cantilever is comprised of permalloy.

19. The method of claim 14 further comprising placing a first raised trace and a second raised trace on said first surface of said substrate such that said cantilever lies between said first and said second raised trace.

20. The method of claim 19 wherein said first and said second raised trace are electrically coupled to RF ground.

21. The method of claim 14 wherein said second surface of said substrate comprises a ground plane.

22. The method of claim 19 wherein said first raised trace is curved.

23. The method of claim 14 wherein said substrate is ceramic.

* * * * *